US005132489A

United States Patent [19]

Yamano

[11] Patent Number: 5,132,489

[45] Date of Patent: Jul. 21, 1992

[54] SHIELDED ELECTRIC CABLE

[75] Inventor: Yoshiaki Yamano, Mie, Japan

[73] Assignee: Sumitomo Wiring System, Ltd., Mie, Japan

[21] Appl. No.: 653,224

[22] Filed: Feb. 8, 1991

[30] Foreign Application Priority Data

Feb. 9, 1990 [JP] Japan ..... 2-12398[U]

[51] Int. Cl.[5] ..... H01B 7/34

[52] U.S. Cl. ..... 174/36; 174/112; 174/115; 174/117 F

[58] Field of Search ..... 174/36, 115, 112, 117 F

[56] References Cited

U.S. PATENT DOCUMENTS

| | | | |
|---|---|---|---|
| 2,043,044 | 6/1936 | Knoderer | 248/464 |
| 3,775,552 | 11/1973 | Schumacher | 174/36 X |
| 4,218,581 | 8/1980 | Suzuki | 174/117 F |
| 4,374,299 | 2/1983 | Kincaid | 174/36 |
| 4,487,992 | 12/1984 | Tomita | 174/36 |
| 4,488,125 | 12/1984 | Gentry et al. | 174/115 X |
| 4,490,574 | 12/1984 | Tomita et al. | 174/36 |
| 4,588,852 | 5/1986 | Fetterolf et al. | 174/36 |
| 4,638,117 | 1/1987 | Ney | 174/117 F |
| 4,943,688 | 7/1990 | Van Deusen et al. | 174/36 X |
| 4,972,041 | 11/1990 | Crawley et al. | 174/36 |

FOREIGN PATENT DOCUMENTS

| | | |
|---|---|---|
| 59-103315 | 7/1984 | Japan . |
| 63-191511 | 12/1988 | Japan . |

*Primary Examiner*—Morris H. Nimmo
*Attorney, Agent, or Firm*—Wenderoth, Lind & Ponack

[57] ABSTRACT

A shielded electric cable includes an insulated conductor having an insulating layer on the exterior of a conductor, a drain wire disposed alongside the conductor and spaced therefrom by a predetermined distance, a shielding layer formed by laterally winding shielding material or a net on the exterior of the conductor, a metal tape electrically connecting the shielding layer to the drain wire, and a jacket in which the conductor, the drain wire, and the metal tape are embedded. Electric wires are integrally connected to and spaced a predetermined distance from the conductor and the drain wire at opposite sides thereof, respectively.

5 Claims, 4 Drawing Sheets

SHIELDED ELECTRIC CABLE

BACKGROUND OF THE INVENTION

1. Field of the Invention

This invention relates to a shielded electric cable to be used as wiring in equipment or in a motor car.

2. Statement of the Prior Art

There are a number of known shielded electric cables. The cables are mainly classified by the following two constructions. A first of these is a construction, as shown in FIG. 5, in which a drain wire 3 is disposed alongside an insulated conductor 1 having an insulating layer 4 on the exterior of a conductor 2, and is spaced therefrom by a predetermined distance P, a metal tape 2 is longitudinally attached to the exterior of the insulated conductor 1 and the drain wire 3, and a jacket 6 covers their exteriors. A second of these is a construction, as shown in FIG. 6, in which the insulated conductor 1 has the insulating layer 4 on the exterior of the conductor 2 and a shielding layer 7 formed by laterally winding a shielding material such as copper wires or a net on the exterior thereof, the drain wire 3 is attached to the shielding layer 7 longitudinally, and the jacket 6 covers their exteriors.

The shielded electric cable as shown in FIG. 5 has the predetermined distance P between the insulated conductor 1 and the drain wire 3. When the shielded electric cable is connected to a connector, a pitch of the connector to receive the insulated conductor 1 and the drain wire 3 can be readily matched to the distance P. Accordingly, the shielded electric cable can be easily connected to the connector. However, a shielding ability and a flexibility of the cable are inferior to those of the cable shown in FIG. 6.

On the other hand, since the shielded electric cable as shown in FIG. 6 has the shielding layer 7, the shielding ability and the flexibility of this cable are superior to those of the cable shown in FIG. 5. However, since the second cable has no distance P between the insulated conductor 1 and the drain wire 3, it is necessary to separate the drain wire 3 from the insulated conductor 1 after working them when they are to be connected to a connector. Accordingly, the process of connecting the cable shown in FIG. 6 to the connector is troublesome.

SUMMARY OF THE INVENTION

An object of this invention is to provide a shielded electric cable which has a good shielding ability and an improved connecting ability.

In order to achieve the object a shielded electric cable according to this invention comprises:

an insulated conductor having an insulating layer on the exterior of a conductor;

a drain wire disposed alongside said conductor and spaced therefrom by a predetermined distance;

a shielding layer formed by laterally winding a shielding material or net on the exterior of said conductor;

a metal tape electrically connecting said shielding layer to said drain wire; and a jacket in which said conductor, said drain wire and said metal tape are embedded so as to form a cover for them.

Since the shielded electric cable of this invention has the predetermined distance between the insulated conductor and the drain wire which are disposed in parallel with each other, a pitch of a receptacle of a connector can be readily matched to that of the predetermined distance and the connection between the connector and the cable can be particularly improved. In addition, a good shielding ability can be obtained, since the shielded conductor has the shielding layer at the exterior thereof.

DETAILED DESCRIPTION OF THE PREFERRED EMBODIMENTS

Figure 1A:
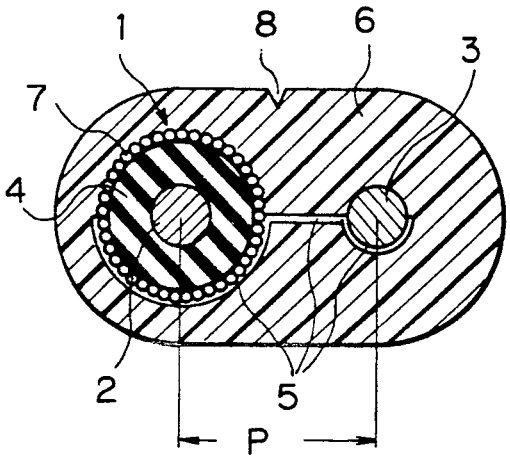
FIG. 1 shows an embodiment of a shielded electric cable according to this invention, FIG. 1A being a cross-sectional view of the cable, FIG. 1B a perspective view, and FIG. 1C being a perspective view of the cable readied for being connected to a connector.
Figure 1B:
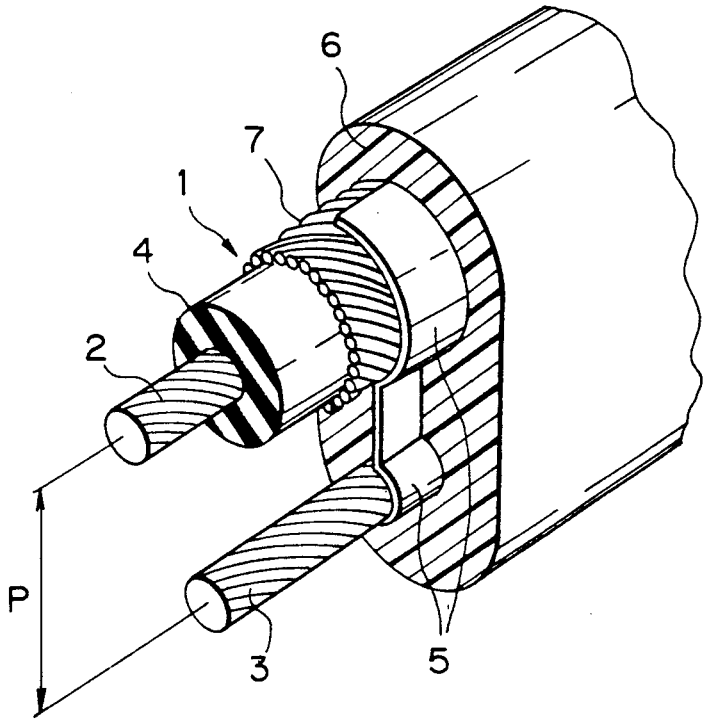

Referring now to FIGS. 1 to 4, preferred embodiments according to this invention will be explained in detail. FIGS. 1A, 1B and 1C illustrate a first embodiment of a shielded electric cable according to this invention. The shielded electric cable comprises an insulated conductor 1 and a drain wire 3. The insulated conductor 1 has an insulating layer 4 made of an insulating resin such as polyethylene on the exterior of a conductor 2 made of twisted wires coated with tin. The insulating layer is formed by ejecting the insulating resin on the exterior of the conductor 2. The drain wire 3 is made of twisted wires coated with tin and is disposed alongside the insulated conductor 1 and is spaced apart from it by a predetermined distance P. The distance P coincides with a pitch of a receptacle of a connector to be connected thereto.

A shielding layer 7 is formed on the exterior of the insulated conductor 1 by laterally winding a shielding material such as copper wires around the insulating layer 4. A metal tape 5 electrically connects the shielding layer 7 with the drain wire 3. An end of the metal tape 5 contacts half of the exterior of said shielding layer 7 and the other end contacts half of the exterior of said drain wire 3. The metal tape 5 is an aluminum foil-polyester-laminated tape.

The insulated conductor 1, the drain wire, and the metal tape are embedded in a jacket 6 made of an insulating resin such as polyvinyl chloride. A notch 8 is formed on the jacket 6 at the center of the jacket in the widthwise direction thereof to indicate internal positions of the conductor 2 and the drain wire 3 in the jacket 6.

Figure 1C:
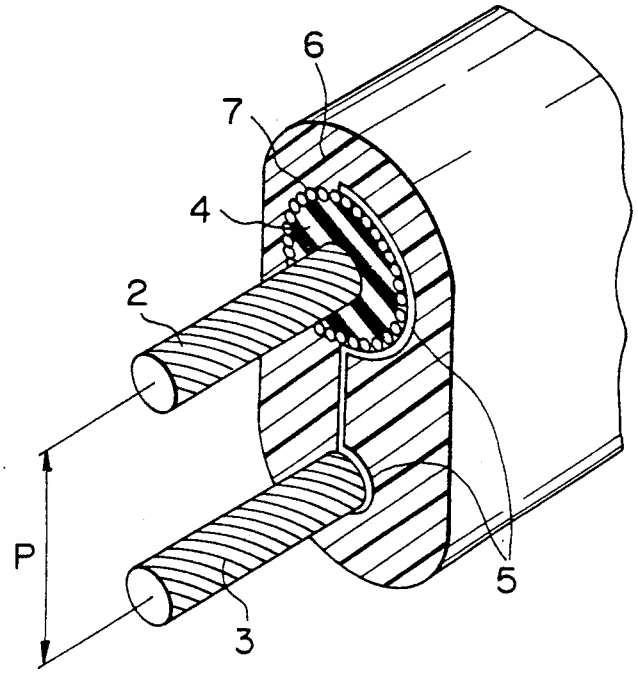
Figure 5:
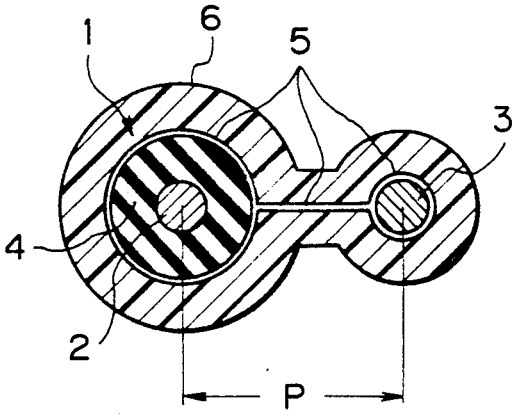
Fig. 5 (PRIOR ART)
FIGS. 5 and 6 are cross-sectional views of conventional shielded electric cables.
Figure 6:
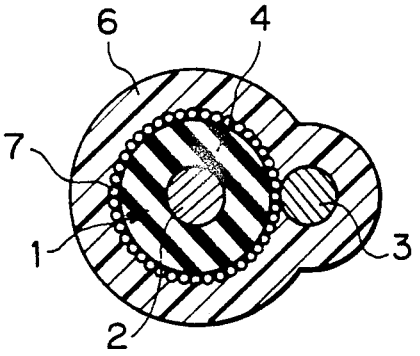
Fig. 6 (PRIOR ART)

When connecting the shielded electric cable to a connector, as shown in FIG. 1C, the insulating layer 4, the shielding layer 7, the metal tape 5, and the jacket 6 are removed from the cable to expose the ends of the conductor 2 and the drain wire 3. Since the distance P between the exposed conductor 2 and the exposed drain wire 3 can be matched to the pitch of the receptacle of the connector, the cable can be readily connected to the connector. Also, since the shielding layer 7 is formed by winding the shielding material on the insulating layer 4 and one half thereof is connected to the metal tape 5, the cable is more flexible than the cable shown in FIG. 5.

Figure 2:
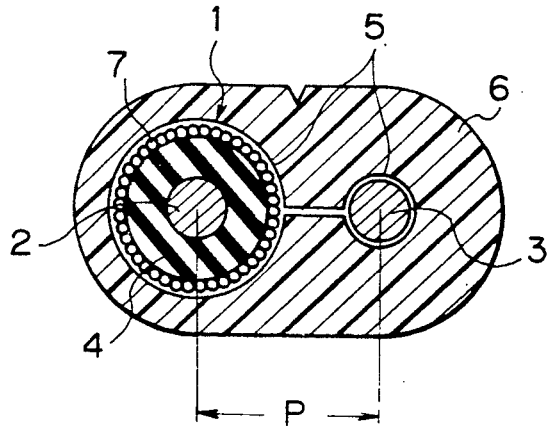
FIGS. 2 to 4 are cross-sectional views of other embodiments of shielded electric cables according to this invention.
Figure 3:
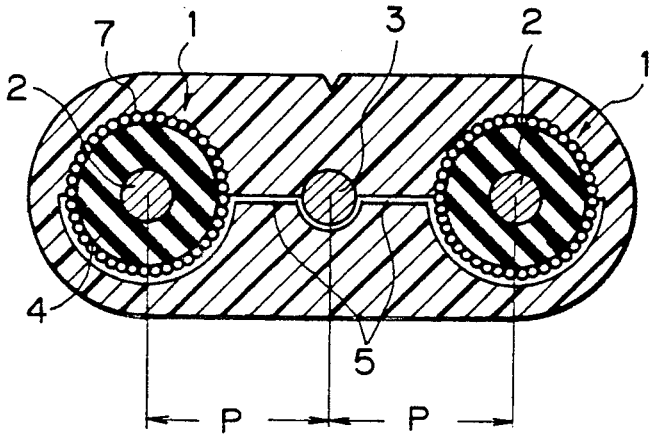
Figure 4:
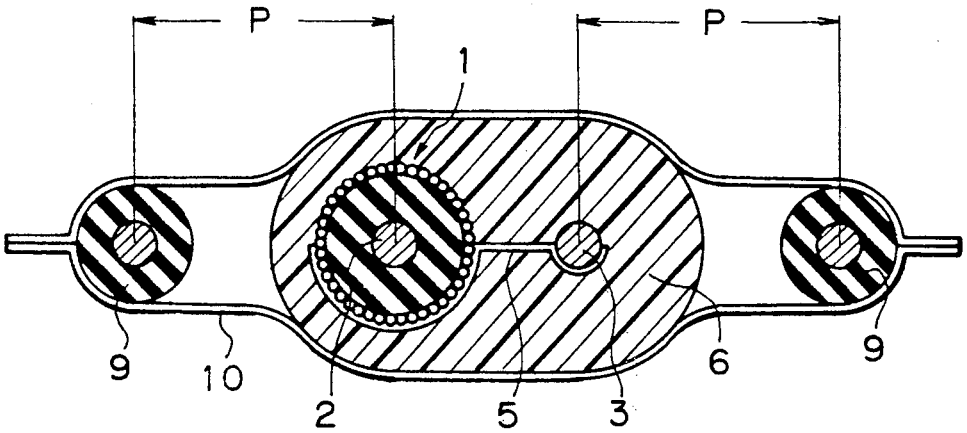

Referring now to FIGS. 2, 3 and 4, second, third and fourth embodiments of shielded cables according to this invention will be described. The cables shown in FIGS. 2 to 4 are modifications having features additional to those of the first embodiment which comprises the insulated conductor 1 having the insulating layer 4 on the exterior of the conductor 2, the drain wire 3, the shielding layer 7, the metal tape 5 and the jacket 6.

In the second embodiment shown in FIG. 2, the metal tape 5 contacts the entire exteriors of the shielding layer 7 and the drain wire 3. The second embodiment has a shielding ability superior to the first embodiment, although the former has a flexibility inferior to the latter.

In the third embodiment shown in FIG. 3, two insulated conductors 1 are disposed alongside a single drain wire 3 and are spaced by a predetermined distance P from both sides of the drain wire 3, respectively.

In the fourth embodiment shown in FIG. 4, conventional electric wires 9 are disposed alongside the insulated conductor 1 and the drain wire 3 and are spaced on both sides thereof, respectively by a predetermined distance P, and a taping means 10 assembles them integrally. The fourth embodiment makes it easy to connect a wire harness having the shielded electric cable with the connector.

It should be noted that the shielding layer 7 may be formed by winding a shielding net made of copper wires on the exterior of the insulating layer 4 as well as by winding laterally the shielding material thereon.

Further, in the third and fourth embodiments shown in FIGS. 3 and 4, an end of the metal tape 5 contacts half of the exterior of the shielding layer 7 and the other end contacts half of the exterior of the drain wire 3, in the same manner as the first embodiment shown in FIG. 1. However, the third and fourth embodiments may incorporate the construction shown in FIG. 2, that is, the metal tape may contact the exterior of both the shielding layer 7 and the drain wire 3 over the entirety thereof.

What is claimed is:

1. A shielded electric cable comprising:

an insulated conducting member including a conductor and an insulating layer on the exterior of said conductor;

a drain wire disposed alongside said conductor and spaced therefrom by a predetermined distance;

a shielding layer on the exterior of said conductor;

a metal tape electrically connecting said shielding layer to said drain wire;

a jacket in which said conductor, said drain wire, and said metal tape are embedded so as to form a cover for them;

electric wires disposed alongside said insulated conducting member and said drain wire, said electric wires spaced a predetermined distance from said conductor and said drain wire, respectively, at both sides thereof; and taping means for integrally connecting said electric wires with said insulated conductor and said drain wire.

2. A shielding cable according to claim 1, wherein said metal tape is an aluminum foil-polyester-laminated tape.

3. A shielding cable according to claim 1, wherein said jacket is provided with a notch therein at the center of the widthwise direction thereof.

4. A shielding cable according to claim 1, wherein one end of said metal tape contacts said shielding layer only at half of an exterior circumferential portion thereof and the other end of said metal tape contacts said drain wire only at half of an exterior circumferential portion thereof.

5. A shielding cable according to claim 1, wherein said metal tape contacts said shielding layer and said drain wire over entire exterior circumferential portions thereof.

* * * * *